US005328336A

United States Patent [19]

Nowobilski

[11] Patent Number: 5,328,336

[45] Date of Patent: Jul. 12, 1994

[54] GETTER CAPSULE

[75] Inventor: Jeffert J. Nowobilski, Orchard Park, N.Y.

[73] Assignee: Praxair Technology, Inc., Danbury, Conn.

[21] Appl. No.: 987,876

[22] Filed: Dec. 9, 1992

[51] Int. Cl.[5] ..... F04B 37/04

[52] U.S. Cl. ..... 417/48

[58] Field of Search ..... 417/48, 49

[56] References Cited

U.S. PATENT DOCUMENTS

| | | | |
|---|---|---|---|
| 3,114,469 | 12/1963 | Francis et al. | 417/48 |
| 3,486,213 | 12/1969 | Maliakal | 29/156.4 |
| 3,811,794 | 5/1974 | Dunkleberger et al. | 417/49 |
| 4,272,259 | 6/1981 | Patterson et al. | 417/48 |
| 4,534,708 | 8/1985 | Magdefessel | 417/51 |
| 4,551,091 | 11/1985 | Paterson | 432/23 |
| 4,571,158 | 2/1986 | Maegdefessel | 417/51 |
| 4,892,142 | 1/1990 | Labaton | 165/134.1 |
| 5,012,102 | 4/1991 | Gowlett | 250/352 |
| 5,191,980 | 3/1993 | Boffito et al. | 417/48 |
| 5,192,240 | 3/1993 | Komatsu | 445/24 |

OTHER PUBLICATIONS

"Engineering With Precision Porous Metals," Mott Metallurgical Corporation, Farmington Industrial Park, Farmington, Conn. 06032, Catalog No. 1000A, undated.

*Primary Examiner*—Richard A. Bertsch
*Assistant Examiner*—David W. Scheuermann
*Attorney, Agent, or Firm*—Chung K. Pak

[57] ABSTRACT

A getter capsule comprising at least one particular container (1 or 10) containing getter particles (9) is useful for removing reactive gases in at least one vacuum space(21*d* or 22*d*). The particular container (1 or 10) may be made of a material containing sintered particles or may be made of a combination of a filtering means (11) and a perforated inorganic pipe or cup (12). At least one closing means (5 or 15) employed in each container (1 or 10) to close or cover the opening (4 or 14) of the container (1 or 10) may be particularly designed to prevent the getter particles (9) from escaping the container (1 or 10) without using any sealants, even when the container (1 or 10) is subject to vibrations.

17 Claims, 4 Drawing Sheets

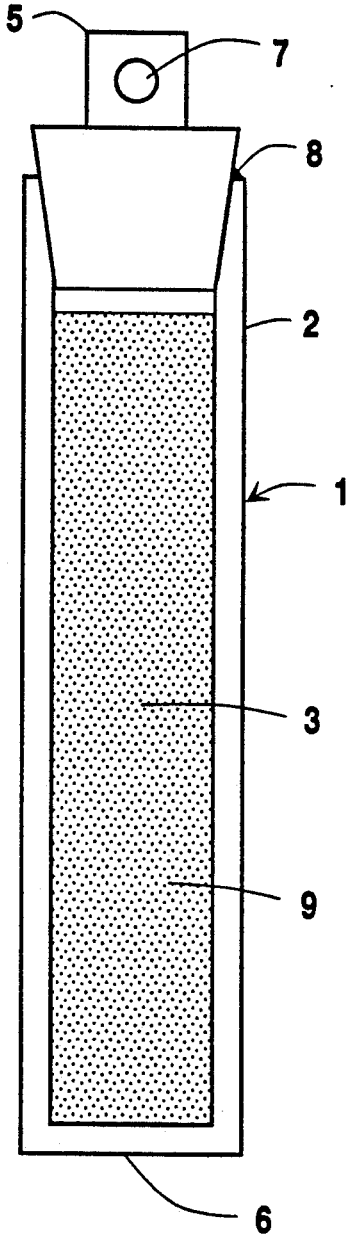
Fig. 1
Fig. 1(a)
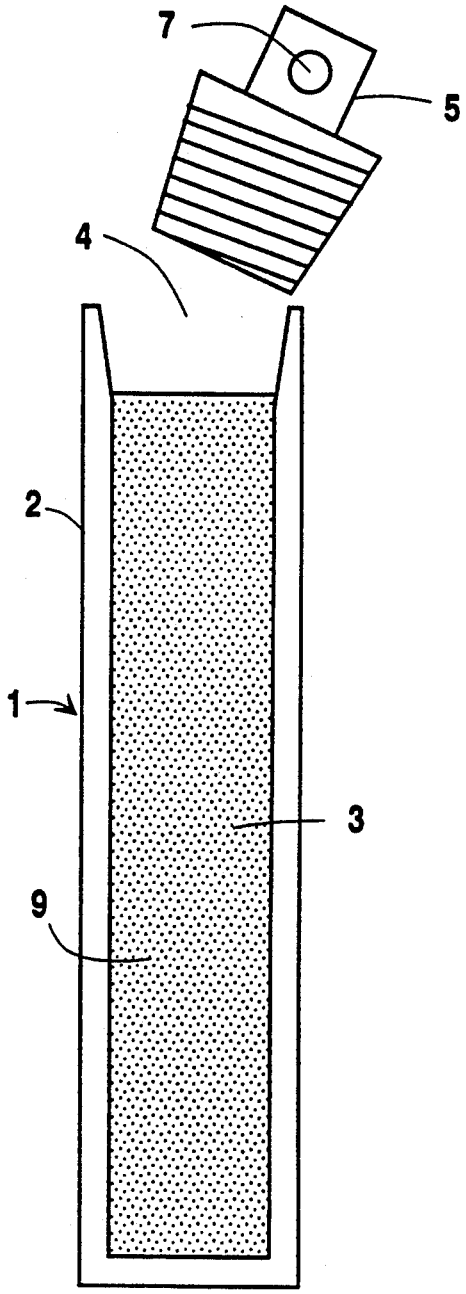

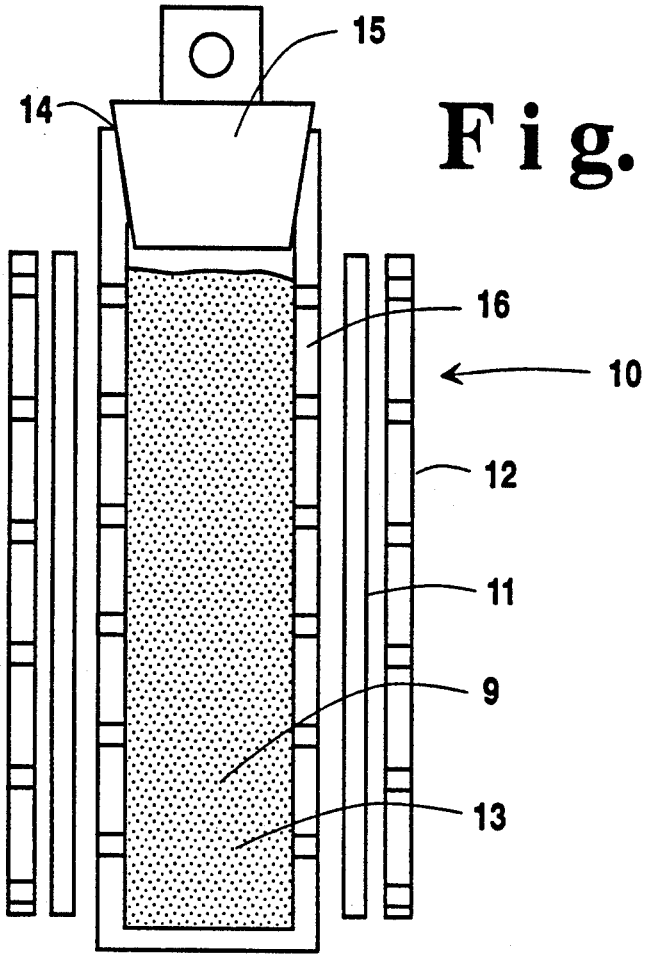
Fig. 4
Fig. 5
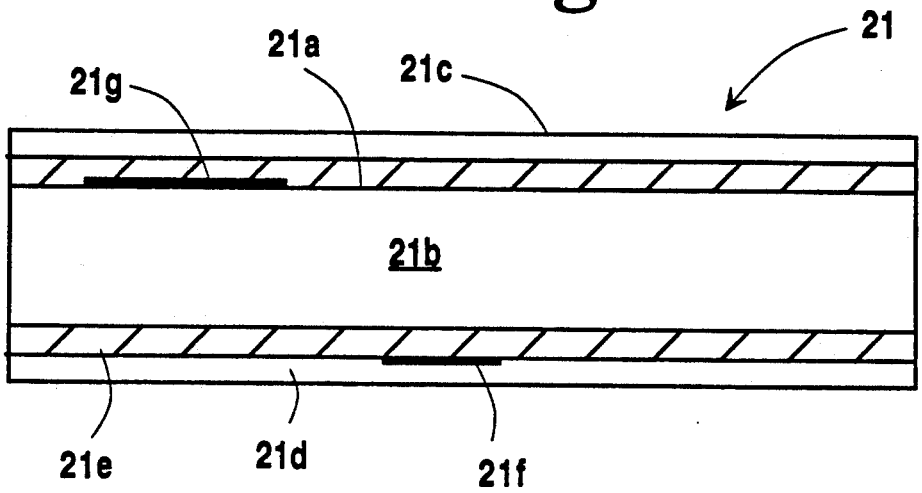

GETTER CAPSULE

FIELD OF THE INVENTION

The present invention relates to a getter capsule useful for removing reactive gases.

BACKGROUND OF THE INVENTION

A getter material is useful for removing various reactive gases in vacuum systems. Palladium oxide(PdO), for example, can be placed within a vacuum space or enclosure to remove hydrogen which is released from the metal components in the vacuum space or enclosure. Initially, the hydrogen reacts with palladium oxide(PdO) to form water which is subsequently removed with molecular sieves in the vacuum space or enclosure. The reaction between palladium oxide(PdO) and hydrogen may be characterized by the following equation:

$$PdO + H_2 \rightarrow Pd + H_2O$$

Once palladium oxide(PdO) is reduced to form palladium metal(Pd), additional hydrogen is removed through using its surface, i.e., chemisorbing hydrogen on its surface.

Employing the getter material, such as palladium oxide, in vacuum insulated equipment, particularly those which are used for handling liquified or low temperature gases, e.g., liquid oxygen, however, can be problematic. If pure oxygen is rapidly introduced into the vacuum space or enclosure via an inner line weld failure, a container weld failure, a neck tube failure or any other structure failures, palladium oxide which has been reduced and has chemisorbed hydrogen on its surface will react with oxygen to generate a temperature up to about 1600 F. This high temperature can melt and ignite an insulation, such as aluminum foil insulation, which is normally used in the vacuum insulated equipment. Once the aluminum foil insulation is ignited, it will burn rapidly resulting in a large energy release which can violently rupture the outer vacuum jacket of the vacuum insulated equipment.

In order to prevent the getter material, such as palladium oxide, from igniting the aluminum insulation, it is packaged before it is employed in the vacuum insulated equipment. Packaging includes placing about 0.5 to about 2 grams of palladium oxide on a piece of a glass paper, folding the glass paper to form a rectangular packet, placing the rectangular glass packet on about 100 mesh copper screen and folding the copper screen over the rectangular glass packet to completely enclose the glass packet. The glass paper and copper screen combine to keep palladium oxide powder within the packet. Also, the copper screen serves as a heat sink to limit the outer surface temperature of the packet in the case of a sudden in-rush of oxygen. Even though the ignition of the insulation can be inhibited or prevented by the above packaging, the structure of the packet or package is susceptible to damage under rough handling conditions. In other words, the glass paper packet can be ripped under rough handling conditions, e.g., creased or unfolded during its installation into the vacuum space or folded incorrectly during fabrication, to release palladium powder therein. The released palladium powder could come into contact with the insulation and may ignite the insulation and rupture the outer vacuum jacket of the vacuum insulated equipment.

Thus, there is a genuine need in the art for a getter containment device which is not susceptible to damage and is useful for employing in vacuum systems.

SUMMARY OF THE INVENTION

Such a genuine need can be met by the present invention which is drawn to a getter capsule comprising getter particles useful for removing undesirable reactive gases in a containment device or container which is constructed with particular materials. The containment device or container comprises at least one enclosure wall defining at least one interior cavity, at least one opening providing access into said at least one interior cavity and at least one closing means covering or closing said at least one opening, thus being able to maintain at least one getter material within said at least one interior cavity. At least one porous enclosure wall and/or at least one closing means is constructed with sintered particles to provide a containment device or container having a particularly sized porous area having particularly sized and distributed pores, a particular porosity, a particular crush strength and a particular heat sink. The porosity, pore size, porous area size and porous wall thickness should be sufficient to retain a pressure drop in the range of about 0.001 to about 10 microns Hg across the thickness of at least one closing means and/or at least one enclosure wall. Moreover, at least one closing means is designed to cover or close at least one opening of the containment device or container in a detachable manner.

Optionally, such a genuine need can also be met by the present invention which is drawn to a getter capsule comprising a containment device or container constructed with at least one inorganic perforated pipe and a filtering means or at least an inorganic perforated cup and a filtering means. The containment device or container generally comprises at least one perforated inorganic pipe or cup defining at least one void volume, at least one opening providing access into said at least one void volume, at least one porous filtering means containing a plurality of pores having a pore diameter in the range of about 0.02 to about 200 micrometers located within said at least one void volume to cover the perforations of the inorganic pipe or cup and at least one closing means for covering said at least one opening. The filtering means may be in the form of an interior plug or an interior wall layer, covering the entire interior surface or substantially the entire interior surface of the perforated inorganic pipe or cup. When the filtering means is used as an interior wall layer, an addition perforated wall layer, which preferably is an inorganic material, may be provided to cover the entire interior surface or substantially the entire interior surface of the filtering interior wall layer. As a substitute for at least one perforated pipe and at least one filtering means, one or more perforated closing means and at least one filtering means can be utilized to provide the desired pressure drop across the thickness of the closing means so that reactive gases or any resulting product can diffuse into or out of the container or containment device. It is desirable that at least one closing means is designed to be detachable so that the containment device or container can be readily opened or closed in order to insert or retain getter particles within the containment device or container.

The above containment devices or containers are designed to be useful for installation in vacuum systems or vacuum insulated equipment. That is, the structures of the containment devices or containers should be such that they can be employed in the vacuum space in the vacuum systems or the vacuum insulated equipment.

As used herein the term "sintered particles" means a powdered material which is fused together under heat and/or pressure to form one piece, e.g., at least a portion of the container wall or closing means.

As used herein the term "porosity" means a ratio of an open area for a fluid flow to the total frontal area.

As used herein the term "detachable closing means" means the closing means which is fabricated or designed to be opened and closed.

As used herein the term "void volume" or "interior cavity" means the space or volume within the container or containment device for retaining particles.

As used herein the term "reactive gas" means any gas other than the group of noble gases in the Periodic Table.

As used herein the term "vacuum systems" means any space or enclosure which is subject to vacuum pressure, i.e., pressure much less than atmospheric, typically a pressure less than 1000 micron Hg.

BRIEF DESCRIPTION OF THE DRAWINGS

FIGS. 1 and 1(*a*) show one embodiment of the invention, which is drawn to a getter capsule comprising at least getter material which is placed within a containment device or container constructed with sintered particles.

FIGS. 2–4 show one embodiment of the invention, which is drawn to a getter capsule comprising at least one getter material and a containment device or container constructed with at least one inorganic perforated pipe and at least one filtering means.

FIG. 5 shows one embodiment of the invention, which is drawn to employing a getter capsule in a vacuum insulated cryogenic liquid transporting pipe.

Figure 2:
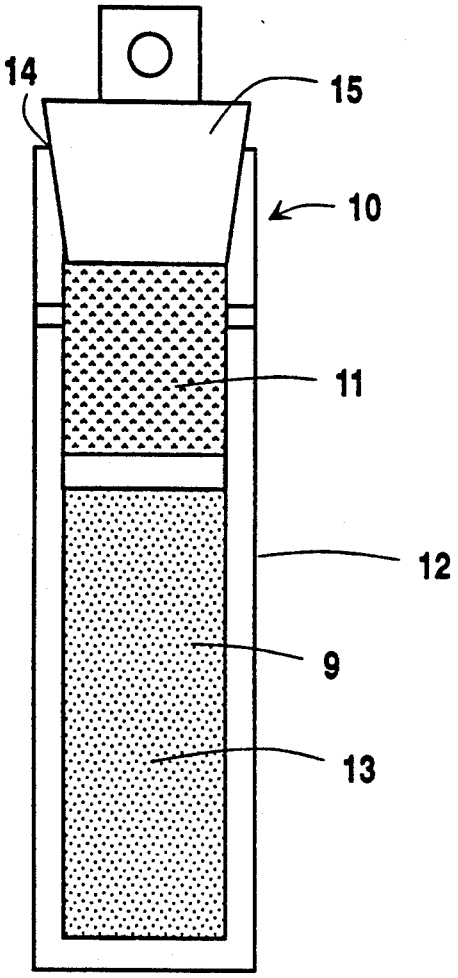

As shown by the above figures, there are several preferred getter capsules useful for removing reactive gases in the vacuum space of equipment for handling industrial gases, such as cryogens. These preferred embodiments in no way preclude other embodiments which will become apparent to those skilled in the art after reading this disclosure.

DETAIL DESCRIPTION OF THE INVENTION

The present invention in part lies in the recognition that a containment device or container constructed with sintered particles is useful for forming a getter capsule which is capable of being employed in vacuum systems. The containment device or container constructed with the sintered particles is found to provide, inter alia, a heat sink sufficient to limit its outer surface temperature to less than the melting point of the aluminum insulation or the ignition temperature of other insulation materials, e.g.,organic insulations, in a vacuum insulated equipment, a crush strength sufficient to increase the margin of safety compared to the package made with copper screen and glass paper and pores sufficiently sized to retain getter powder within its interior cavity and, at the same time, to allow reactive gases, such as hydrogen, and any product gases, such as water, to diffuse into or out of its interior cavity. The sufficiently sized pores are also uniformly distributed to enhance the reaction between the getter material and the gas impurities since the gas impurities can be uniformly distributed to the surface of the getter material in the container.

The present invention also lies in the recognition that perforated inorganic pipes or cups, and/or perforated closing means in conjunction with at least one filtering means having particular pore sizes can be used to construct a getter containment device or container which is useful as a getter capsule. The perforated inorganic pipe or cup is used to provide a heat sink sufficient to limit the outer surface temperature of the container to less than the melting point of the aluminum insulation or the ignition temperature of other insulation materials in a vacuum insulated equipment, a crush strength sufficient to increase the margin of safety compared to the package made with copper screen and glass paper and pores sufficiently sized to allow reactive gases, such as hydrogen and/or any product gases formed, such as water, to diffuse into or out of the interior cavity of the container. The filtering means, on the other hand, is placed within the pipe or cup to cover the perforations thereof with substantially uniformly distributed pores which are sufficiently sized to retain getter powder within the container and, at the same time, to allow reactive gases, such as hydrogen, to uniformly diffuse into the container and products, such as water, to diffuse out of the container.

Now referring to FIGS. 1 and 1*a*, there is illustrated a containment device or container (1) which has at least one enclosure wall (2) defining at least one interior cavity (3), at least one opening (4) and at least one closing means (5) covering or closing the opening (4). The bottom (6) may be part of at least one enclosure wall (2) or may be one of the closing means (5). The enclosure wall (2) and/or closing means (5) is fabricated with sintered particles or a mixture of sintered particles and non-sintered particles in such a manner to provide a pressure drop of about 0.001 to about 10 micron Hg across the thickness of the enclosure wall and/or the closing means, a crush strength of at least about 5 lb, preferably at least about 200 lb, to the containment device or container and a heat sink mass of at least about 2 grams of the containment device or container per about 1 gram of any getter material inserted therein. In other words, the thickness, porosity, pore size and porous surface of the enclosure wall and/or closing means are designed to provide the above pressure drop, crush strength and heat sink requirements. The desired porous enclosure wall and/or porous closing means is normally constructed to provide a thickness in the range of about 0.01 to 0.6 inches, preferably about 0.05 to about 0.08 inches, a total porosity in the range of about 10%–65%, preferably about 25%–50%, based on the total exterior surface of the enclosure wall and/or closing means, which normally has an area in the range of 0.5 $inch^2$ to 20 $inch^2$, preferably about 1 $inch^2$ to 5 $inch^2$, and a plurality of pores having a pore diameter in the range of about 0.2 to about 200 micrometers, preferably about 0.5 to about 40 micrometers. As the wall and/or closing means is designed closer to the preferred design, the concentration of undesirable reactive gas can be reduced to an acceptable level in a cost effective manner. For instance, the preferred pore diameter or size can retain very small getter powder within the interior cavity and, at the same time, allow the reactive gases, such as hydrogen, and any product formed, such as water, to diffuse into or out of the interior cavity of the container. By being able to increase the reaction surface of the getter material through using small getter powder and by being able to diffuse gas and liquid in a sufficient amount, the removal of gaseous impurities is enhanced.

The sintered particles employed are preferably inorganic sintered particles, such as sintered metal particles, sintered ceramic particles, sintered glass particles, sintered alloy particles or mixtures thereof. Of these sintered particles, sintered stainless steel particles, particularly those sold under the name "316 SS" are normally most preferred since they impart a substantial crush strength and uniform pore distribution to the getter containment device or container (1). Some instances, sintered metal materials, such as sintered copper, sintered bronze, sintered monel or sintered ceramic may be most preferred due to their compatibility with oxygen.

As indicated above, the closing means can be constructed with the sintered particles to provide the necessary porous structure, e.g., porosity, pore size and porous area, or non-sintered material to form the non-porous structure. Any closing means, e.g., welded structure, can be used as long as getter powder can be retained within the container. However, the preferred closing means is normally designed to prevent getter powder from escaping the interior cavity of the container or containment device even when the container or containment device is subject to vibrations and is designed to be detachably, releasably or removably closed, i.e., designed to be opened, so that at least one getter material can be easily replaced once it is deactivated or is no longer useful for removing undesirable reactive gases. The closing means having such functions is, among other things, a plug having a tapered thread. This desired plug having a tapered thread may be defined by a generally cylindrical threaded body part having an upper section which has a diameter greater than a lower section and a head part for turning or rotating the threaded body part. On the head part, a bore or a hole (7), which may be used to secure the getter capsule inside the vacuum space, may be provided.

As the container is subject to vibrations, the plug having a tapered thread, unlike a plug having a straight thread, maintains the getter powder within the container and prevents the same from migrating along the thread and escaping the container, without the use of thread sealants, such as teflon tape, adhesives or pastes. Being able to close the opening of the container with the plug without any sealant can be important since failure to apply a sealant during the manufacture of a container having a sealant required closing means, e.g., a plug having a straight thread, can pose a safety hazard or can result in vacuum offgassing or oxygen compatibility problems.

Once the plug having a tapered thread is used to close the opening of the container having a threaded section which is shaped to accommodate the tapered thread, a tack weld (8) may be provided to hold the plug in position. The tack weld (8) further prevents the plug from being loosen during handling or due to vibration. In providing the tack weld (8), however, the getter powder, such as palladium oxide powder, contained in the container should not be heated above 300° F. Heating the getter powder to above that temperature may be detrimental to reactivity of the getter powder. To prevent the getter powder from overheating during welding to provide a tack weld, a copper heat sink or other heat sink means may be clamped or used around the container.

Figure 3:
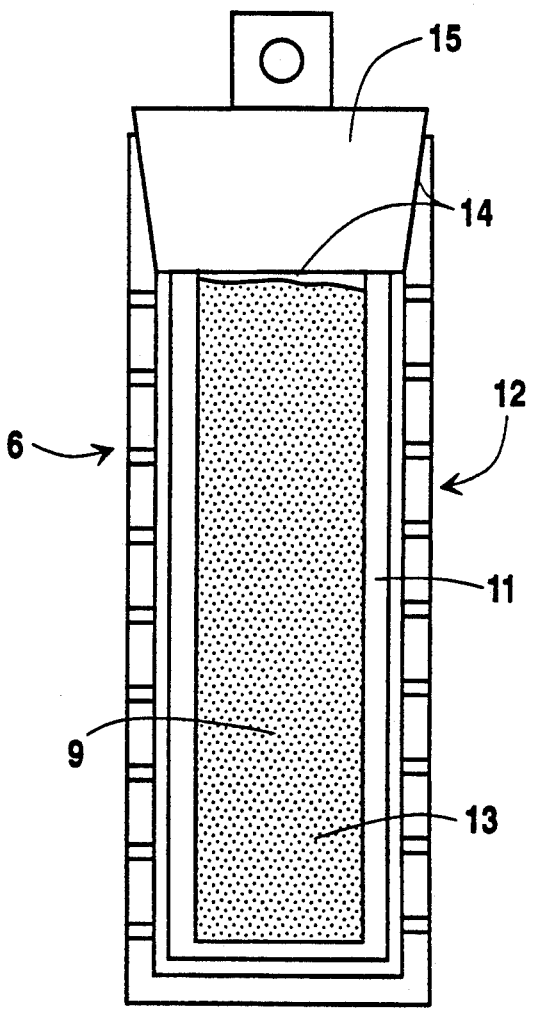

Referring to FIGS. 2–4, containment devices or containers (10) constructed with filtering means (11) and at least one inorganic perforated pipe or cup shape outer wall layer (12) are illustrated. These containment devices or containers (10) generally comprise at least one perforated inorganic pipe or cup (12) defining at least one void volume (13), at least one opening (14) providing access into at least one void volume (13), at least one filtering means (11) containing a plurality of pores having a diameter in the range of about 0.02 to about 200 micrometers, preferably about 0.05 to about 40 micrometers, located within the pipe or cup to cover the perforations thereof and at least one closing means (15) covering the opening. The perforated inorganic cup or pipe provides perforations sufficient to provide a pressure drop of at least about 0.001 micron Hg across the thickness of the pipe or cup wall, a crush strength of greater than about 5 lb, preferably greater than about 200 lb, and a heat sink mass of at least about 1 gram, preferably at least about 2 grams, of the containment device or container per about 1 gram of any getter material inserted therein. The filtering means, on the other hand, provides a plurality of pores having a diameter or a size which can retain very small getter powder within the container and, at the same time, allow reactive gases, such as hydrogen and product gases, such as water, to diffuse into or out of the container. The filtering means may be in the form of an internal plug covering the opening and perforations of the pipe or cup (FIG. 2) or a wall layer covering the entire or substantially the entire interior wall surface of pipe or cup (FIGS. 3 and 4). When the filtering means is used as an interior wall layer, an additional perforated wall layer (16), which preferably is an inorganic material, may be provided to cover the entire interior surface or substantially the entire interior surface of the filtering interior wall layer. The perforations on the pipe or cup and the porosity, pore size, thickness and porous surface area of the filtering means are designed to provide a pressure drop of about 0.001 to about 10 micron Hg across the thickness of the filtering means. As a substitute for at least one perforated pipe or cup, one or more perforated closing means may be utilized to achieve the desired pressure drop across the thickness of the filtering means. Commonly, at least one closing means is not usually perforated. It is preferably designed to be detachably, releasably or removably closed, i.e., designed to be opened, so that the containment device or container can be readily opened or closed and is designed to prevent getter powder from escaping the container. A plug having taper thread section which comports with the shape of the opening having a thread section is useful for the above purposes.

The getter material (9) employed within the containment devices or containers of FIGS. 1–4 is useful for removing gaseous impurities. The preferred getter material is useful for removing hydrogen, oxygen and/or nitrogen and may be selected from Palladium oxide, barium and/or platinum dioxides. It is usually used in the form of powder to increase its reaction surface. The desired sizes of the getter powder are in the range of less than about 860 micron to greater than about 74 micron. This getter powder should not be compacted into the container or containment device, i.e., in the interior cavity, during the loading since the compacted powder reduces the void area or gap between the powder particles and increases the resistance to the flow of reactive gases, thus inhibiting the removal of the reactive gases.

It is desirable to provide a clearance between the getter powder surface and the bottom or the interior surface of the plug so that the getter powder is not compacted. The preferred clearance between the getter powder surface and the bottom of the plug, which faces the getter powder, is at least about 0.05 inches. The amount of the getter powder normally employed is in the range of about 0.1 to about 10 grams. It is understood that the term "getter powder" as used herein may include adsorbents and/or catalysts if the adsorbents and/or catalysts are used in the same or similar manner as the getter particles.

Figure 6:
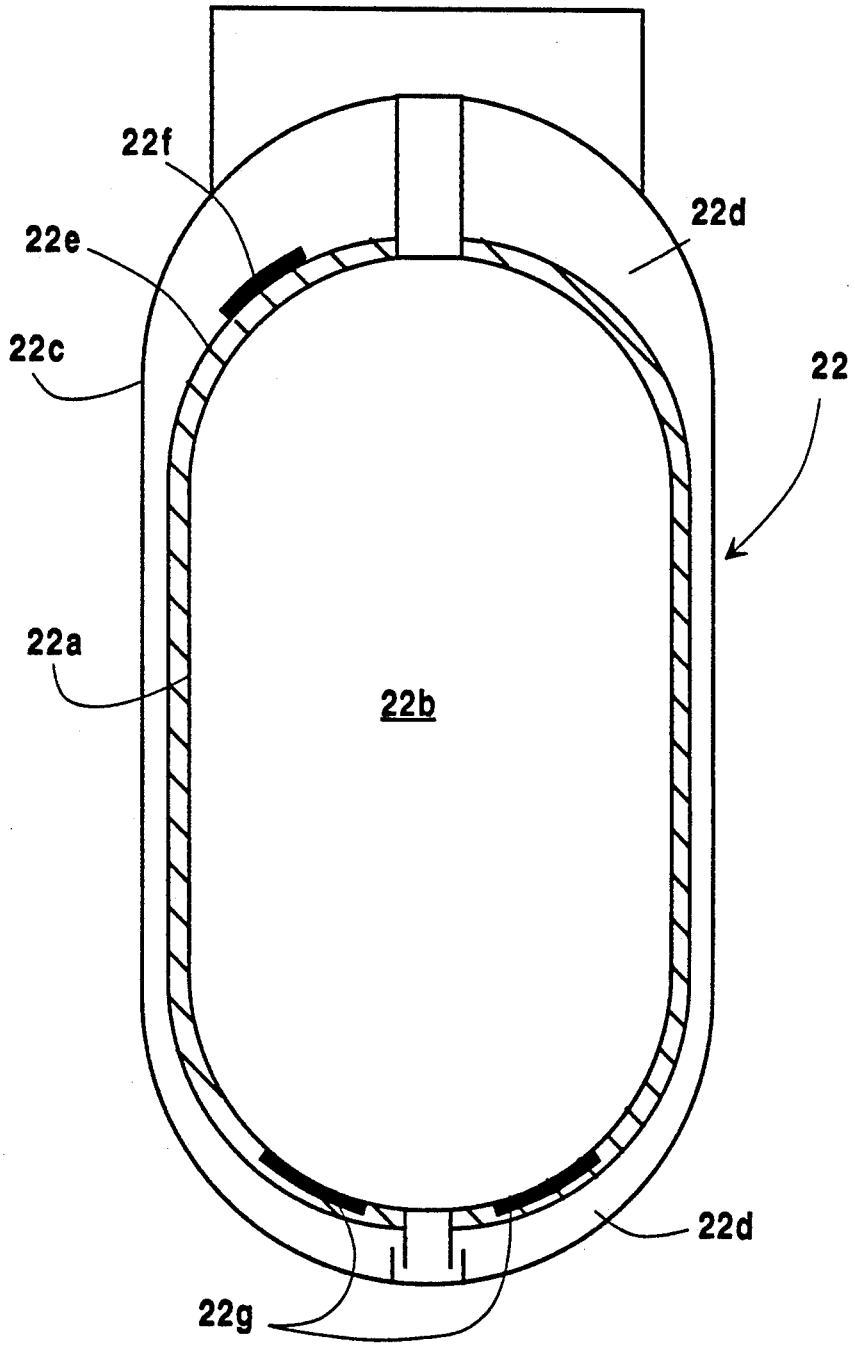
FIG. 6 shows one embodiment of the invention, which is drawn to employing a getter containment device or container having at least one getter material in a vacuum insulated liquified gas container.

As shown in FIGS. 5–6, any number of the getter capsules of FIGS. 1–4 can be employed in vacuum insulated equipment. The getter capsules can be located anywhere in the vacuum space of the vacuum insulated equipment as long as they are in good communication with the vacuum space. FIGS. 5 and 6 illustrate vacuum insulated pipe (21) useful for transporting cryogens (liquified gases) and vacuum insulated container (22) useful for containing cryogens, respectively. The vacuum insulated pipe (21) has at least one pipe (21*a*) having at least one passageway (21*b*) for transporting cryogens, at least one vacuum jacket (21*c*) surrounding the pipe (21*a*) to form the annular vacuum space (21*d*) therebetween, at least one insulation (21*e*) at least partially surrounding the pipe (21*a*) in the vacuum space (21*d*), at least one getter capsule (21*f*) comprising a containment device and getter powder in the vacuum space (21*d*) and at least one molecular sieve (21*g*) useful for removing liquid, such as water in the vacuum space (21*d*). Similarly, the vacuum insulated container (22) comprises at least one container wall (22*a*) defining at least one void volume (22*b*) for retaining cryogens, at least one vacuum jacket (22*c*) surrounding the container wall (22*a*) to form the vacuum space (22*d*) therebetween, at least one insulation (22*e*) at least partially surrounding the container wall (22*a*) in the vacuum space (22*d*), at least one getter capsule (22*f*) comprising a containment device and getter powder in the vacuum space (22*d*) and at least one molecular sieve (22*g*) useful for removing liquid, such as water, in the vacuum space (22*d*). The above vacuum insulated equipment may be made with, inter alia, carbon steel or stainless steel vacuum jacket, container wall and/or pipe and aluminum insulation. It is, however, understood that any conventional material may be used to make the pipe, container, insulation foil and vacuum jacket.

The getter capsule is normally employed in convenient locations in the vacuum space of the pipe and cylinder so that the getter powder, such as palladium oxide, therein can react with a gaseous impurity, such as hydrogen, which is released from metal components exposed to the vacuum space, e.g., carbon steel or stainless steel vacuum jacket, pipe or cylinder wall and aluminum insulation. For instance, the hydrogen impurity initially reacts with palladium oxide(PdO) to form water which is subsequently removed with molecular sieves in the vacuum space. The reaction between palladium oxide(PdO) and hydrogen may be characterized by the following equation:

$$PdO + H_2 \rightarrow Pd + H_2O$$

Once palladium oxide(PdO) is reduced to form Palladium metal(Pd), additional hydrogen is removed through using its surface, i.e., chemisorbing hydrogen on its surface.

Although the apparatus of the present invention has been described in detail with reference to certain embodiments, those skilled in the art will recognize that there are other embodiments within the spirit and scope of the invention.

What is claimed is:

1. A getter capsule capable of being installed in a vacuum system, said getter capsule comprising a container having at least one interior cavity and getter particles placed within said at least one interior cavity of the container, the container comprising at least one enclosure wall defining said at least one interior cavity, at least one opening providing access into said at least one interior cavity and at least one closing means covering or closing said at least one opening, thus maintaining said getter particles within said at least one interior cavity, wherein said at least one enclosure wall or said at least one closing means is porous and is constructed with a material comprising sintered particles.

2. The getter capsule according to claim 1, wherein said material consists essentially of sintered particles which are selected from the group consisting of sintered metal particles, sintered glass particles, sintered ceramic particles, sintered alloy particles and mixtures thereof.

3. The getter capsule according to claim 1, wherein a clearance between the surface of said getter particles within said interior cavity and a bottom surface of said at least one closing means for closing or covering said at least one opening is at least about 0.05 inches.

4. The getter capsule according to claim 1, wherein said getter particles are powder palladium oxide, powder barium and/or powder platinum dioxide.

5. The getter capsule according to claim 1, wherein said at least one enclosure wall or said at least one closing means is constructed to provide a pressure drop in the range of about 0.001 to about 10 micron Hg across the thickness of the closing means or the enclosure wall and a heat sink mass of at least about 1 gram of said container per about 1 gram of said getter particles.

6. The getter capsule according to claim 5, wherein said at least one enclosure wall is constructed to provide an enclosure wall thickness in the range of about 0.05 to about 0.08 inches, a total porosity in the range of about 25% to about 50% based on the total exterior surface area of said porous enclosure wall, with said total exterior surface area being in the range of about 1 to about 5 square inches and a plurality of pores having a pore diameter in the range of about 0.5 micrometer to about 40 micrometers.

7. The getter capsule according to claim 1, wherein said at least one closing means comprises at least one plug which is screwed to and/or welded onto said at least one opening to maintain said getter particles within said interior cavity.

8. The getter capsule according to claim 7, wherein said at least one plug which is screwed to said at least one opening has a tapered thread useful for preventing said getter particles from escaping said interior cavity.

9. A container capable of being used as a getter capsule in a vacuum system, said container comprising at least one perforated inorganic wall defining at least one void volume, at least one opening providing access into said at least one void volume, at least one porous filtering means containing a plurality of pores having a pore diameter in the range of about 0.02 to about 200 micrometers placed within said at least one void volume to cover the perforations of said at least one perforated inorganic wall, and at least one closing means for closing or covering said at least one opening.

10. The container capable of being used as a getter capsule in a vacuum system according to claim 9, wherein said at least one closing means is at least one plug having a generally cylindrical threaded body and a head section for turning said generally cylindrical threaded body, said generally cylindrical threaded body being tapered so that is upper section has a diameter greater than its lower section and wherein said at least one opening is defined by a threaded section which is shaped to accommodate said plug.

11. The container capable of being used as a getter capsule in a vacuum system according to claim 9, wherein said at least one filtering means is porous glass filter and/or porous ceramic filter means, which is provided within the void volume in the form of a wall layer or an interior plug.

12. A container capable of being used as a getter capsule in a vacuum system, said container comprising at least one enclosure wall defining at least one interior cavity, at least one opening providing access into said at least one interior cavity and at least one closing means releasably or removably covering or closing said at least one opening so that getter particles can be placed within or removed from said at least one interior cavity, wherein said at least one enclosure wall or said at least one closing means is porous and is constructed with a material comprising sintered particles.

13. The container capable of being used as a getter capsule in a vacuum system according to claim 12, wherein said at least one closing means is at least one plug having a generally cylindrical threaded body and a head section for turning said generally cylindrical threaded body, said generally cylindrical threaded body being tapered so that its upper section has a diameter greater than its lower section and wherein said at least one opening is defined by a threaded section which is shaped to accommodate said plug.

14. The container capable of being used as a getter capsule in a vacuum system according to claim 12, further comprising at least one tack weld.

15. The container capable of being used as a getter capsule in a vacuum system according to claim 12, wherein said at least one enclosure wall is constructed to provide an enclosure wall thickness in the range of about 0.05 to about 0.08 inches, a total porosity in the range of about 25% to about 50% based on the total exterior surface area of said porous enclosure wall, with said total exterior surface area being in the range of about 1 to about 5 square inches and a plurality of pores having a pore diameter in the range of about 0.5 micrometer to about 40 micrometers.

16. A vacuum insulated equipment comprising: at least one enclosure wall defining at least one void volume or passageway, at least one vacuum jacket surrounding said at least one enclosure wall to form at least one vacuum space therebetween, at least one insulation surrounding at least portion of said at least enclosure wall within said at least one vacuum space and at least one getter capsule within said at least one vacuum space, said getter capsule comprising a container having at least one interior cavity and getter particles placed within said at least one interior cavity of the container, the container comprising at least one wall defining said at least one interior cavity, at least one opening providing access into at least one interior cavity and at least one closing means covering or closing said at least one opening, thus maintaining said getter particles within said at least one interior cavity, wherein said at least one wall or said at least one closing means is porous and is constructed with a material comprising sintered particles.

17. The vacuum insulated equipment according to claim 16, further comprising molecular seive materials within said at least one vacuum space.

* * * * *

UNITED STATES PATENT AND TRADEMARK OFFICE

CERTIFICATE OF CORRECTION

PATENT NO. : 5,328,336

DATED : July 12, 1994

INVENTOR(S) : Jeffert J. Nowobilski

It is certified that error appears in the above-identified patent and that said Letters Patent is hereby corrected as shown below: Column 10:

In claim 16, line 6, please insert --one-- before "enclosure".

Signed and Sealed this

Eighteenth Day of October, 1994

*Attest:*

*Attesting Officer*

BRUCE LEHMAN

*Commissioner of Patents and Trademarks*